US011735862B2

(12) United States Patent
Lin et al.

(10) Patent No.: US 11,735,862 B2
(45) Date of Patent: Aug. 22, 2023

(54) ELECTRICAL CONNECTOR ASSEMBLY HAVING IMPROVED LOCKING PORTIONS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Juan Lin, Kunshan (CN); Chun-Hsiung Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 9 days.

(21) Appl. No.: 17/394,779

(22) Filed: Aug. 5, 2021

(65) Prior Publication Data

US 2022/0045459 A1 Feb. 10, 2022

(30) Foreign Application Priority Data

Aug. 5, 2020 (CN) ..... 202010776128.2

(51) Int. Cl.
*H01R 13/627* (2006.01)
*H01R 13/428* (2006.01)
(Continued)

(52) U.S. Cl.
CPC ..... *H01R 13/6273* (2013.01); *H01R 12/79* (2013.01); *H01R 13/055* (2013.01);
(Continued)

(58) Field of Classification Search
CPC ..... H01R 13/627; H01R 13/6273; H01R 13/428; H01R 13/502; H01R 13/639;
(Continued)

(56) References Cited

U.S. PATENT DOCUMENTS 4,402,564 A * 9/1983 Frantz ..... H01R 12/79 439/449
9,991,631 B2 * 6/2018 Zhao ..... H01R 13/6273
(Continued)

FOREIGN PATENT DOCUMENTS

CN 101635413 A 1/2010
CN 105990720 A 10/2016
(Continued)

*Primary Examiner* — Gary F Paumen
(74) *Attorney, Agent, or Firm* — Ming Chieh Chang

(57) ABSTRACT

An electrical connector assembly includes a board connector and a cable connector. The board connector includes a first seat comprising a base and two first sidewalls commonly defining a mating space, and a pair of first locking portions with locking heads projecting into the mating space, and a plurality of first terminals retained in the first seat and comprising contacting portions projecting into the mating space and leg portions. The cable connector includes a second seat including a pair of second locking portions to engage with the first locking portions and plural second terminals retained in the second seat. The first seat of the board connector further includes a second sidewall unitarily connecting with the base and first sidewalls at a same side and the second sidewall defines a first locking section to engage with a second locking section defined on the cable connector.

7 Claims, 9 Drawing Sheets

(51) Int. Cl.

| | |
|---|---|
| ***H01R 13/502*** | (2006.01) |
| ***H01R 13/639*** | (2006.01) |
| ***H01R 13/05*** | (2006.01) |
| ***H01R 13/11*** | (2006.01) |
| ***H01R 13/629*** | (2006.01) |
| ***H01R 12/79*** | (2011.01) |

(52) U.S. Cl.
CPC ..... *H01R 13/113* (2013.01); *H01R 13/428* (2013.01); *H01R 13/502* (2013.01); *H01R 13/629* (2013.01); *H01R 13/639* (2013.01)

(58) Field of Classification Search
CPC .. H01R 13/055; H01R 13/113; H01R 13/629; H01R 12/79
USPC ..... 439/357
See application file for complete search history.

(56) References Cited

U.S. PATENT DOCUMENTS

| | | | | |
|---|---|---|---|---|
| 10,790,614 | B1 * | 9/2020 | Chen | H01R 12/721 |
| 2010/0279534 | A1 * | 11/2010 | Byrnes | H01R 12/716 439/55 |
| 2012/0184127 | A1 * | 7/2012 | Hanyu | H01R 13/6273 439/370 |
| 2017/0331210 | A1 * | 11/2017 | Chen | H01R 12/77 |
| 2018/0040977 | A1 | 2/2018 | Zhao et al. | |
| 2018/0226748 | A1 * | 8/2018 | Hayasaka | H01R 13/641 |
| 2020/0366016 | A1 * | 11/2020 | Hsiao | H01R 13/6583 |
| 2020/0403355 | A1 * | 12/2020 | Zhu | H01R 12/716 |

FOREIGN PATENT DOCUMENTS

| | | | |
|---|---|---|---|
| CN | 111525338 | A | 8/2020 |
| CN | 213401771 | U | 6/2021 |

* cited by examiner

ELECTRICAL CONNECTOR ASSEMBLY HAVING IMPROVED LOCKING PORTIONS

BACKGROUND OF THE INVENTION

1. Field of the Invention

The present invention relates to an electrical connector assembly including a board connector and a cable connector mating with each other.

2. Description of Related Arts

China Patent No. CN206004039U discloses an electrical connector assembly including a board connector and a cable connector. The board connector is mounted on a printed circuit board and includes two opposite sidewalls without any top and bottom walls. The cable connector is inserted into the board connector in multiple directions, such as a front and rear direction, or a slant direction, or an upright direction. The elastic locking or latching members of the board connector are engaged with the cable connector to ensure a steady engagement of the two connectors.

In actual mating process, the engagement of the two connectors still presents a risk of disconnection. Therefore, an improved electrical connector assembly is desired to overcome the disadvantages of the prior arts.

SUMMARY OF THE INVENTION

An object of the present invention is to provide an electrical connector assembly, a board connector and a cable connector with higher engaging forces.

In order to achieve above-mentioned object, an electrical connector assembly comprises: a board connector including a first seat comprising a base and two opposite first sidewalls commonly defining a mating space and a pair of first locking portions with locking heads projecting into the mating space, and a plurality of first terminals retained in the first seat and comprising contacting portions projecting into the mating space and leg portions extending out of the base; and a cable connector adapted for mating with the board connector, the cable connector comprising a second seat comprising a pair of second locking portions to engage with the first locking portions of the board connector, and a plurality of second terminals retained in the second seat, wherein the first seat of the board connector further comprises a second sidewall unitarily connecting with the base and the first sidewalls at a same side, and the second sidewall defines a first locking section to engage with a second locking section defined on the cable connector.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
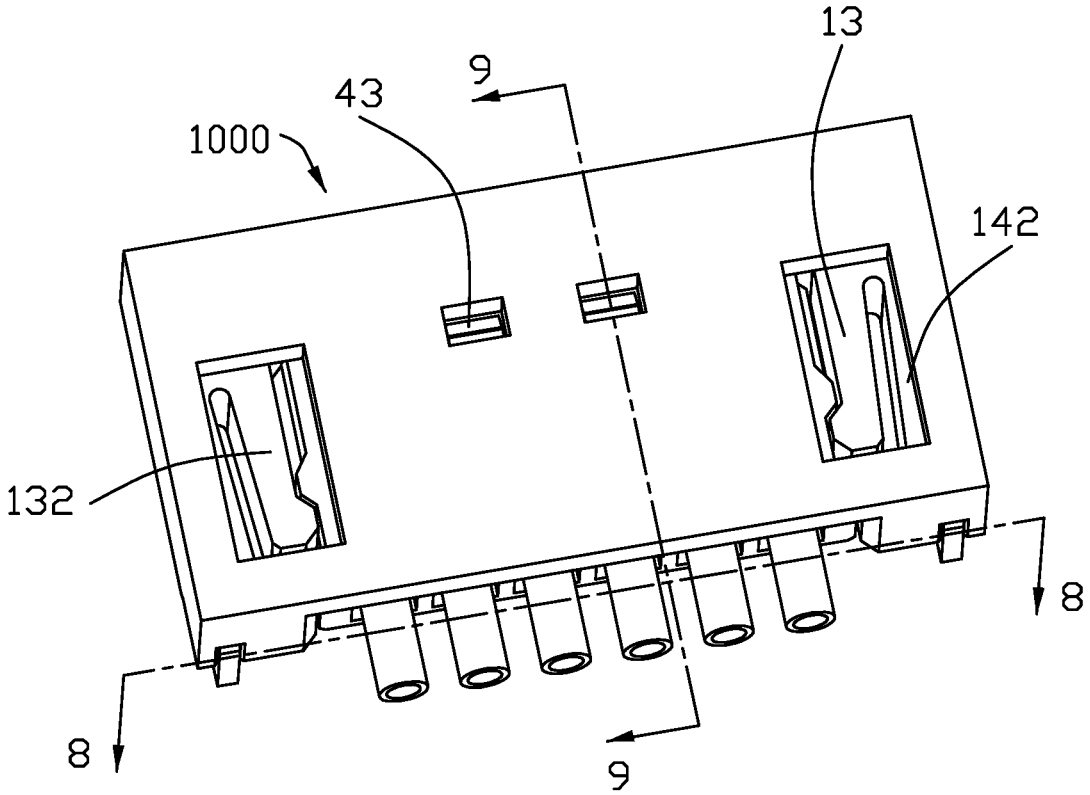
FIG. 1 is a perspective view of an electrical connector assembly including a board connector and a cable connector mating with each other in accordance with the present invention.
Figure 2:
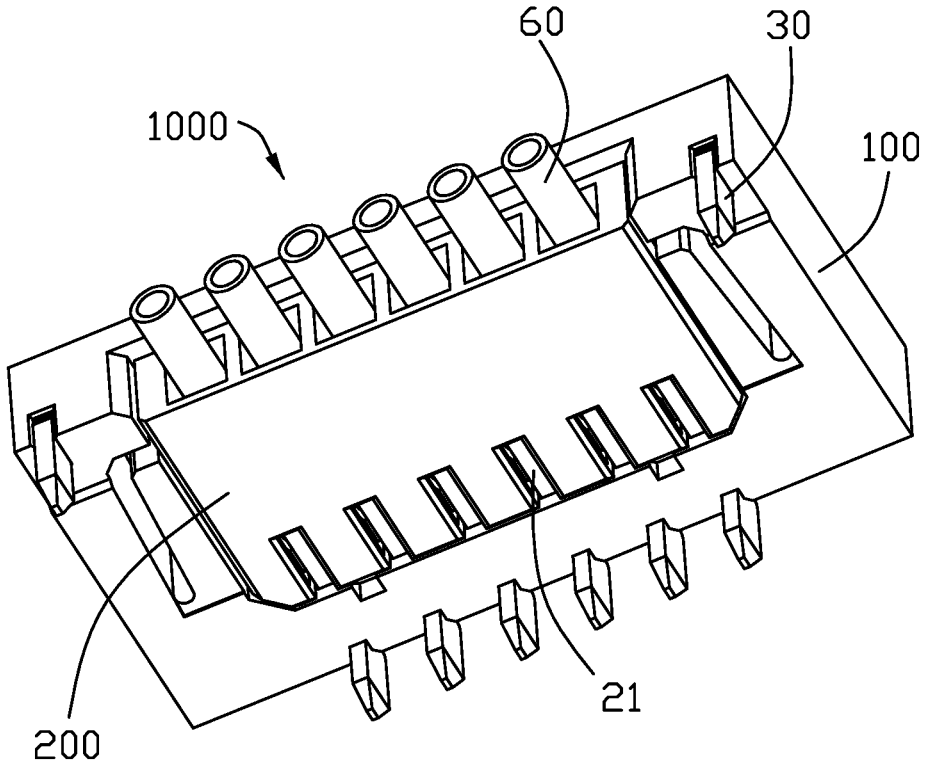
FIG. 2 is another perspective view of the electrical connector assembly in FIG. 1.

Reference will now be made to the drawing figures to describe the preferred embodiment of the present invention in detail.

Referring to FIGS. 1 to 9, an electrical connector assembly 1000 of one embodiment of this present invention includes a board connector 100 adapted for being mounted on a printed circuit board (not shown) and a cable connector 200 mating with each other. The cable connector 200 is connecting with a plurality of cables 60 at a rear end thereof. The board connector 100 has blade type terminals 20 for a large power current.

Figure 3:
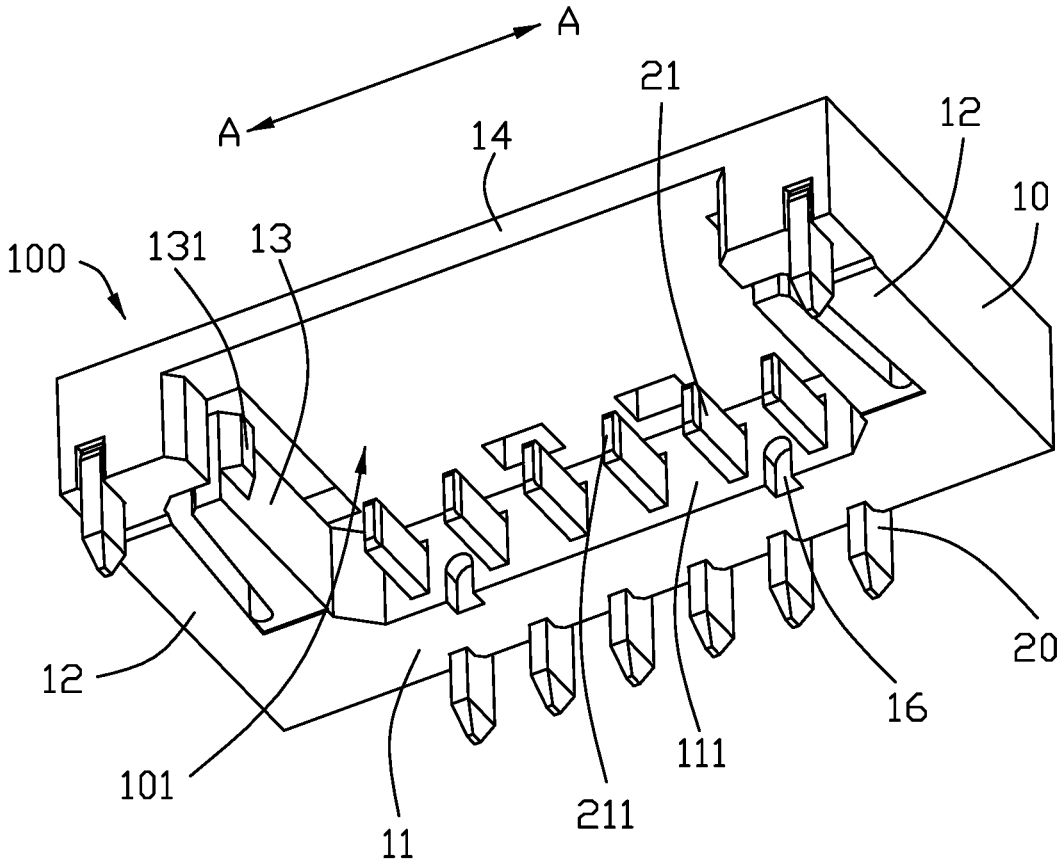
FIG. 3 is a perspective view of the board connector in FIG. 2.
Figure 4:
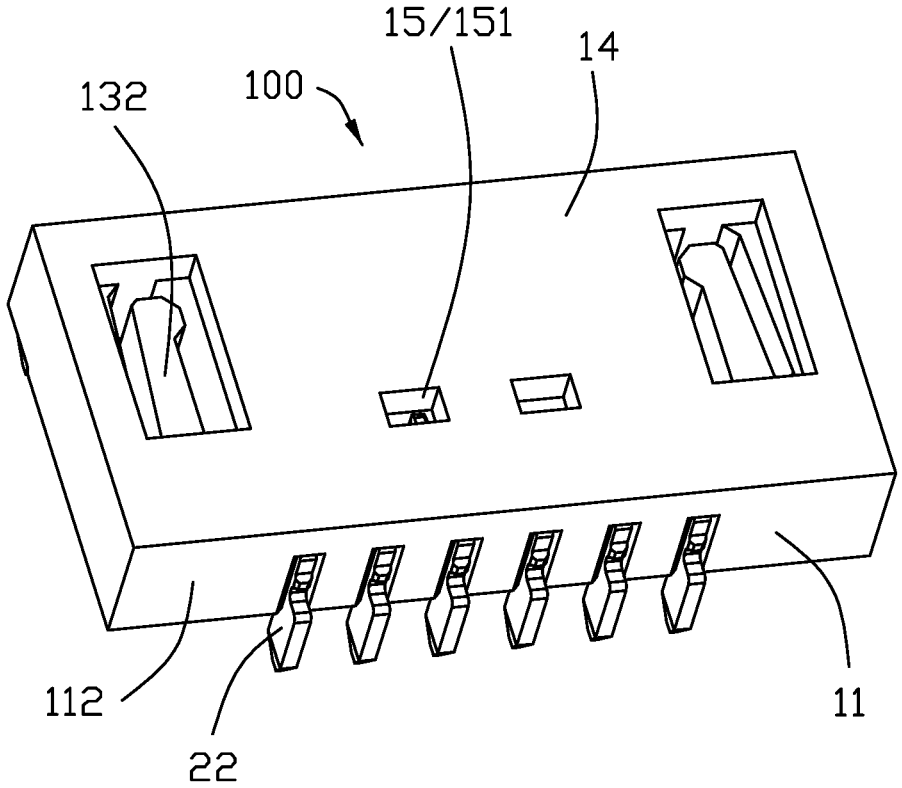
FIG. 4 is another perspective view of the board connector in FIG. 3.

Referring to FIGS. 3 and 4, the board connector 100 includes a first seat 10 and a plurality of first terminals 20 retained in the first seat. The first seat 10 includes a rear portion or base 11 and two opposite first sidewalls 12 commonly defining a mating space 101 among the base portion 11 and two first sidewalls 12, and two first lock portions 13 with locking bosses 131 protruding into the mating space 101. The first seat 10 is made from insulating material. Combination with FIGS. 7-8, the first terminals 20 retained in the base 11, includes contacting portions 21 protruding into the mating space 101 and leg portions 22 extending out the base 11, and retaining portions 23 retained in the base 11 and jointing with the contacting portions 21 and the leg portions 22. The retaining portions 23 and the contacting portions 21 are of an upright board shape and define two concave portions 231, 232 and tow convex portions 233, 234, four of which are located higher one by one, so as to enlarge the retaining forces between the retained portions 23 and the base 11. The leg portions 22 are located behind the convex portions 234 and exposing to an exterior behind the rear face 112 of the base to ensure a retaining force between the base 11 and the printed circuit board.

In this embodiment, a first direction A-A is defined perpendicular to the first sidewalls 12, i.e., a lateral direction or a left and right direction, the contacting portions 21 are arranged between the two first sidewalls 12 along the first direction. The first locking portions 13 are of a cantilever arm which unitarily extends from the base 11 and at an inside of the corresponding first sidewall 12. The first locking portions 23 are near to the mating space 101 and deform along the first direction. A pair of board-retaining member 30 is retained at the bottom of the base and mounts the board, connector 100 on the printed circuit board.

The first seat 11 further includes a second sidewall 14, which unitarily connecting with the same sides of the base 11 and the first sidewalls 12. In this embodiment, the board connector 100 is horizontally mounted on the printed circuit board, the second sidewall 14 is on the upper face of the base 11, and the base 11 has no second sidewall on the lower face thereof, the leg portions 22 extend across the lower face of the base 11 and are soldered to the printed circuit board. The contacting portions 21 extend forward from the front face 111 of the base 11. The first locking portion 13 is in a form of a cantilever arms 132 extending from the front face 111 of the base 11 and reach near to the front face of the board connector 100. The locking bosses 131 project inwards along the first direction from the distal ends of the cantilever arms 132. In alternative embodiment, the first locking portions can be other arm shape or made from metal material retained in the base.

The second sidewall 14 unitarily defines a first locking section 15, and the first locking section 15 is in a form of at least one locking hole 151 running through the second sidewall 14 along a second direction which is perpendicular to the second sidewall 14. The two locking holes 151 are located between the front ends 211 of the contacting portions 21 and front face 111 of the base 11 along a front and rear direction. The second sidewall 14 defines two longitudinal slots 142 corresponding to the first locking portions 13, each first locking portion 13 is surrounded within the longitudinal slot 142 along the second direction to ensure the deforming shift space for the cantilever arm 132.

Figure 5:
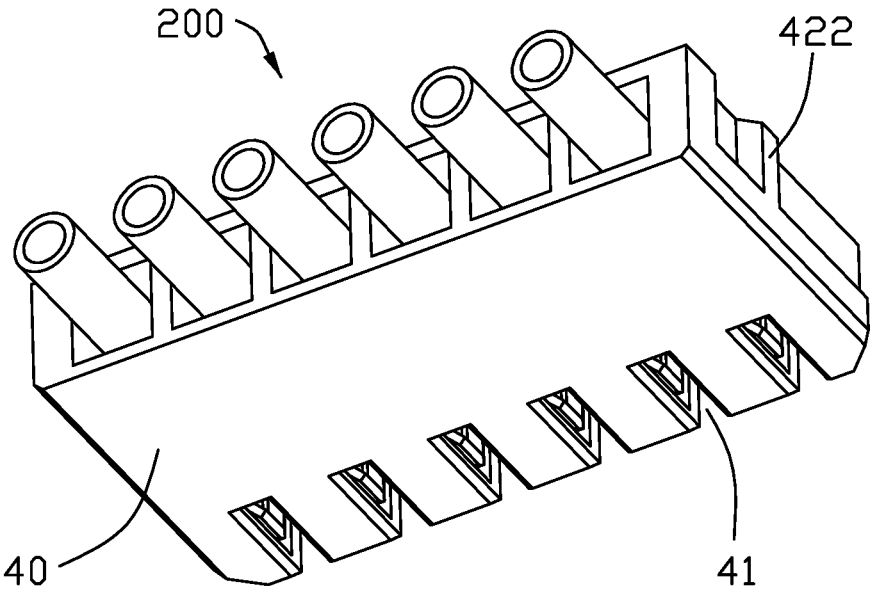
FIG. 5 is a perspective view of the cable connector in FIG. 2.
Figure 6:
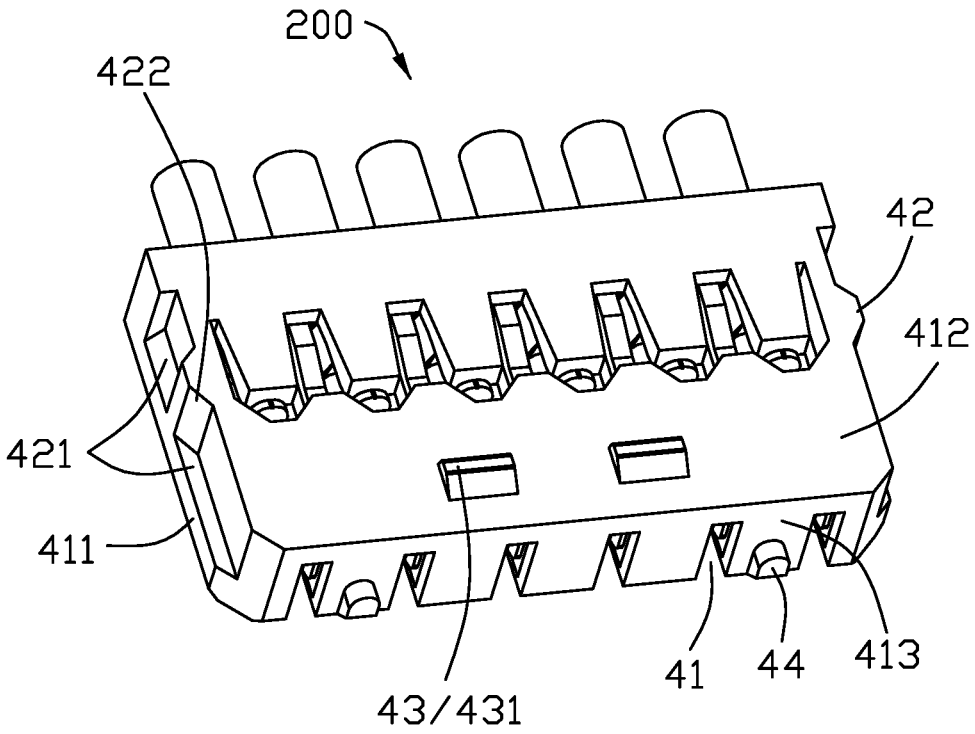
FIG. 6 is another perspective view of the cable connector in FIG. 5.
Figure 7:
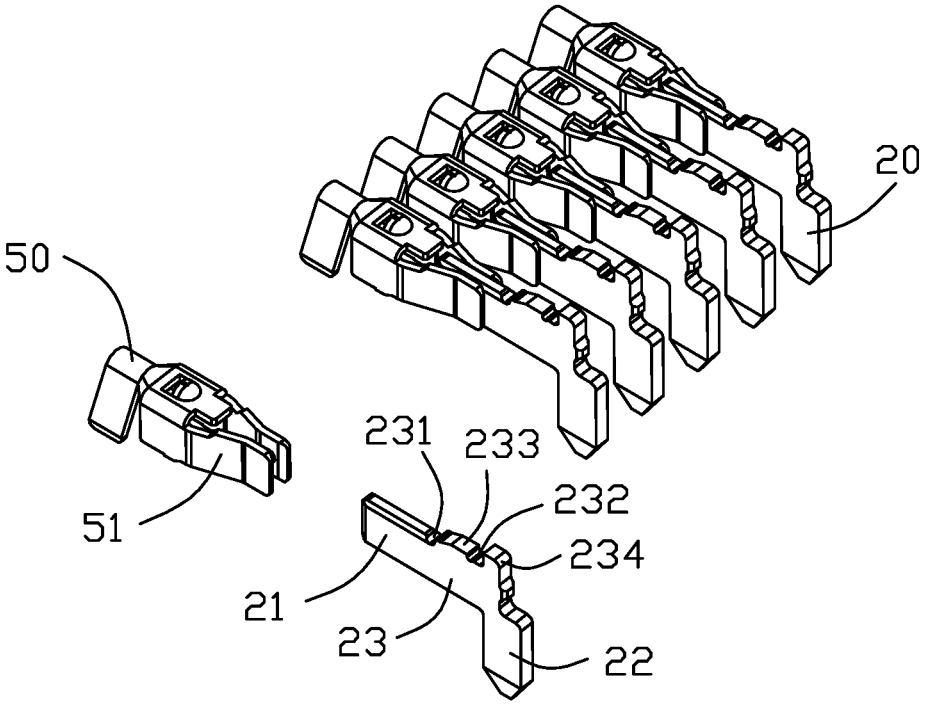
FIG. 7 is a perspective view of the first and second terminals, wherein one of first terminals is disconnect from the second terminal.
Figure 8:
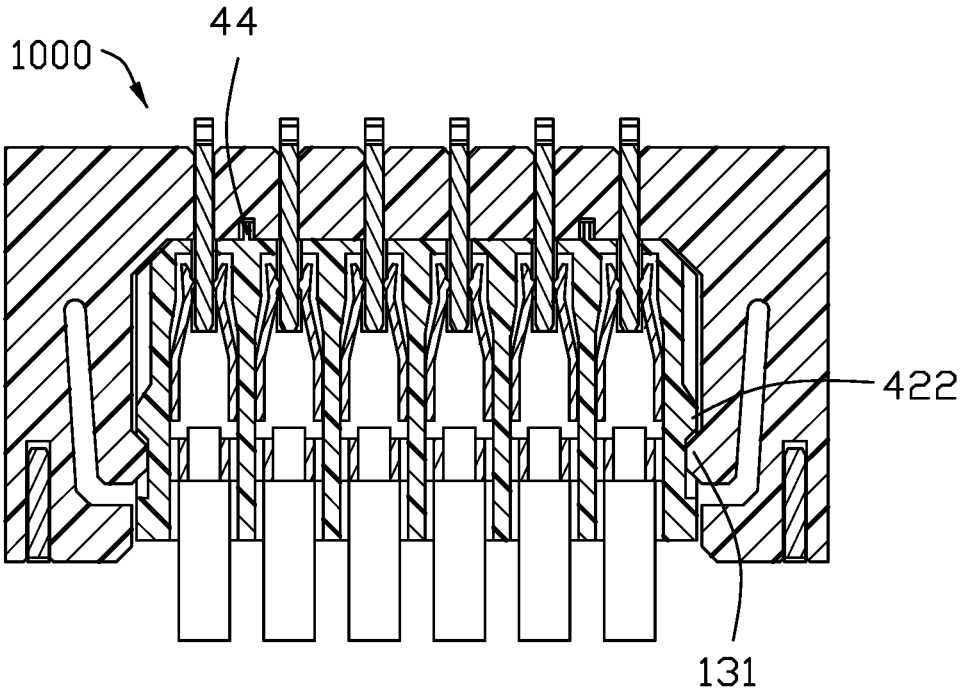
FIG. 8 is a cross sectional view of the electrical connector assembly taken along line 8-8 in FIG. 1.
Figure 9:
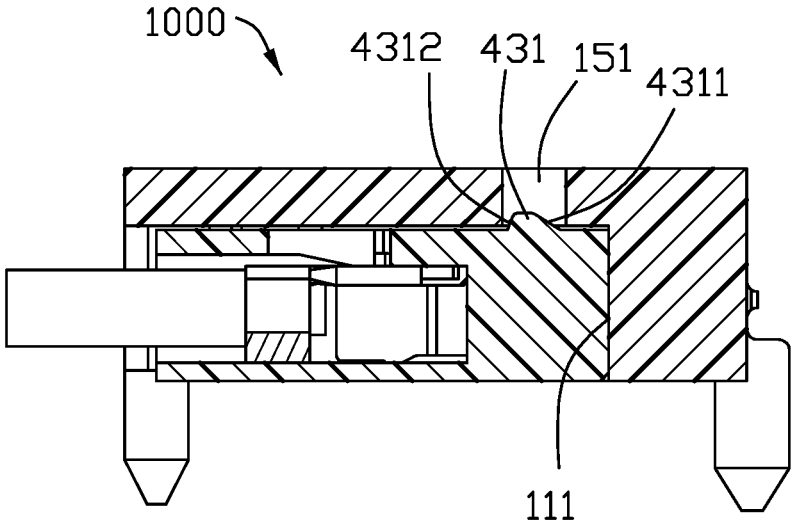
FIG. 9 is a cross sectional view of the electrical connector assembly taken along line 9-9 in FIG. 1.

Referring to FIGS. 5 to 7, the cable connector 200 includes a second seat 40 and a plurality of second terminals 50 arranged along the first direction. The second seat 40 of a rectangular shape includes two opposite first small face 411 along the first direction and two opposite second or large face 412 connecting with the first faces at a same side, and a front face 143. The second seat 40 defines passageways 143 arranged along the first direction for receiving the second terminals 50. The passageways 143 run through the front face 413 and one of the large faces 412. The second terminal 50 includes a pair of elastic contacting portions 51 into which the blade contacting portion 21 of the first terminal 20 is inserted. The cables 60 are connecting with the rear ends of the second terminals 50. The passageways 143 extend through the front face 413 and one of the second faces 412. The second seat 40 further defines two second locking portions 42 and a second locking section 43. The second locking portions 42 are defined on the first face 411, the first face 411 defines a recessed portion 421 and a projecting portion 422 in the recessed portion 421 to partition the recessed portion 421 in two parts. The recessed portion 421 and the projecting portion 422 commonly form said second locking portion 42. The second locking section 43 is located at one of the second face 412, which is in a form of two locking bumps 431 on the second face.

The front face 413 of the second seat 40 further defines two posts 44 projecting forward, to mate with the holes 16 defined on the front face 111 of the base 11 after the two connectors 100, 200 are mated with each other. The holes 16 extend beyond the bottom face of the base 11 so as to limit the slim shift of the two connectors along the first direction.

The second seat 40 is received in the mating space 101 of the first seat 10 after the cable connector 200 is inserted into the board connector 100 along the front and rear direction. Combination with FIGS. 8-9, during the first faces 411 of the second seat 40 slide along the first locking portions 13, the projecting portion 422 push the first locking portions 13 shift outwards and then the locking bosses 131 stride over the projecting portions 422. Then the first locking portions 13 return to the original statute and the locking bosses 131 are received in the recessed portions 421. The locking boss 131 and the projecting portion 422 lock against each other in the front and rear direction to prevent the first and second locking portions from disconnection in the front and rear direction. At the same time, the locking bump 431 defines a front slanting face 4311 to guide the locking bumps 131 into the locking holes 151 and a back slanting face 4312 for guiding function during the disconnection of the plug connector 200 from the board connector 100. The angle of the front slanting face 4311 is smaller than that of the rear slanting face, which result in a smaller inserting force while a larger pull-out force.

The board connector 100 is horizontally mounted on the printed circuit board, the plug connector is inserted in the board connector only in the front to rear direction. The engagement of the two connectors is kept steady by said two types of locking portions/sections.

However, the disclosure is illustrative only, changes may be made in detail, especially in matter of shape, size, and arrangement of parts within the principles of the invention.

What is claimed is:

1. A board connector adapted for mating with a cable connector, comprising:

a first seat comprising a base, two opposite first sidewalls arranged along a first direction, and a second sidewall connecting with the base and the first sidewalls at top faces thereof; and a plurality of first terminals retained in the base and comprising contacting portions projecting from a front face of the base and arranged along the first direction between the two first sidewalls;

wherein the second sidewall defines a first locking section for engaging with a corresponding second locking section defined on the cable connector;

wherein a pair of first locking portions is provided at an inside of the first sidewalls, and the first locking portions are capable of deforming in the first direction; and wherein the second sidewall defines two longitudinal slots aligned with the first locking portions, and the first locking portion is surrounded within a corresponding longitudinal slot in a second direction perpendicular to the first direction.

2. The board connector as claimed in claim 1, wherein the first locking section comprises at least one locking hole or at least one locking bump.

3. The board connector as claimed in claim 2, wherein the at least one locking hole runs through a lower face of the second sidewall.

4. The board connector as claimed in claim 1, wherein the at least one locking hole is located between front ends of the contacting portions and the base in the second direction.

5. The board connector as claimed in claim 1, wherein the second sidewall defines two locking holes distinct from each other along the first direction for serving as the first locking section.

6. The board connector as claimed in claim 1, wherein the first locking portion comprises a cantilever arm unitarily extending from the base.

7. The board connector as claimed in claim 6, wherein the cantilever arm is provided with a locking boss at a front end thereof, the locking boss is disposed at an upper portion of the front end of the cantilever arm.

* * * * *